US010272549B2

(12) United States Patent
Oliver Lagardera

(10) Patent No.: US 10,272,549 B2
(45) Date of Patent: Apr. 30, 2019

(54) HINGED RATCHET WRENCH

(71) Applicants: Emilio Blasco Monter, Castelldefels (ES); Sergio Oliver Lagardera, Begues (ES)

(72) Inventor: Sergio Oliver Lagardera, Begues (ES)

(73) Assignee: Emilio BLASCO MONTER, Castelldefels (ES)

( * ) Notice: Subject to any disclaimer, the term of this patent is extended or adjusted under 35 U.S.C. 154(b) by 178 days.

(21) Appl. No.: 15/324,063

(22) PCT Filed: Jul. 7, 2014

(86) PCT No.: PCT/ES2014/000114
§ 371 (c)(1),
(2) Date: Jan. 5, 2017

(87) PCT Pub. No.: WO2016/005611
PCT Pub. Date: Jan. 14, 2016

(65) Prior Publication Data

US 2017/0157754 A1 Jun. 8, 2017

(51) Int. Cl.
*B25B 13/46* (2006.01)
*B25B 23/00* (2006.01)
*B25G 1/06* (2006.01)

(52) U.S. Cl.
CPC ..... *B25B 23/0028* (2013.01); *B25B 13/463* (2013.01); *B25B 13/468* (2013.01); *B25G 1/06* (2013.01); *B25G 1/063* (2013.01)

(58) Field of Classification Search
CPC ..... B25B 13/14; B25B 13/18; B25B 13/463; B25B 13/468; B25B 13/0028; B25G 1/06; B25G 1/063
(Continued)

(56) References Cited

U.S. PATENT DOCUMENTS 266,595 A * 10/1882 Owen ..... B25B 13/463 81/62
331,627 A * 12/1885 Farrar ..... B25B 13/16 81/163

(Continued)

FOREIGN PATENT DOCUMENTS

ES 0215567 A3 7/1954
FR 637741 A 5/1928

OTHER PUBLICATIONS

International Search Report and Written Opinion of relevant PCT application No. PCT/ES2014/000114 dated Mar. 26, 2015.

(Continued)

*Primary Examiner* — Joseph J Hail
*Assistant Examiner* — Arman Milanian
(74) *Attorney, Agent, or Firm* — Silvia Salvadori

(57) ABSTRACT

The ratchet wrench comprises a functional head (1) and a handle (2) hingedly connected to each other, a ratchet toothed wheel (4) rigidly attached to the functional head (1), a movable ratchet pawl (5) installed on the handle (2), a working spring (6) that biases the ratchet pawl (5) against the ratchet wheel (4), a movable releasing member (7) installed on the handle (2) and manually operable to move the ratchet pawl (5) to a position out of engagement with the ratchet wheel (4), and a movable locking element (69) installed on the handle (2) and manually operable between a rest position, in which it does not interfere with the ratchet pawl (5), and a locking position, in which it comes into contact with the ratchet pawl (5) holding it in said engaged position with the ratchet wheel (4).

20 Claims, 9 Drawing Sheets

(58) Field of Classification Search
USPC ..... 81/163, 60, 63.1, 63.2, 61, 62
See application file for complete search history.

(56) References Cited

U.S. PATENT DOCUMENTS 690,688 A * 1/1902 Barnes ..... B25B 13/16 81/163
804,568 A * 11/1905 Thompson ..... B25B 13/463 81/163
889,194 A * 6/1908 Bovee ..... B25G 1/063 81/163
1,188,801 A * 6/1916 McEwen ..... B25B 13/463 81/163
1,381,128 A 6/1921 Matheny
1,541,898 A * 6/1925 Chamberlain ..... B25B 13/463 81/163
1,868,892 A 7/1932 Lillie Fyffe
4,016,782 A * 4/1977 Guimarin ..... B25B 13/16 81/163
4,112,792 A * 9/1978 Guimarin ..... B25B 13/16 81/163
4,277,989 A * 7/1981 Tracy ..... B25B 13/463 192/43.1
4,300,413 A * 11/1981 Garofalo ..... B25B 13/463 81/62
4,445,404 A * 5/1984 Parker ..... B25B 13/463 81/62
4,589,307 A * 5/1986 Parker ..... B25B 13/463 81/62
4,703,676 A * 11/1987 Mayer ..... B25B 13/463 81/60
4,722,253 A * 2/1988 Chow ..... B25B 13/463 81/62
5,000,066 A * 3/1991 Gentiluomo ..... B25B 13/463 81/62
5,582,080 A * 12/1996 Barmore ..... B25B 13/463 81/177.85
5,622,089 A * 4/1997 Gifford, Sr. ..... B25B 13/462 192/43.1
5,761,972 A * 6/1998 Sanders ..... B25B 13/462 81/60
7,430,849 B1 * 10/2008 Coutts ..... B21L 21/00 29/243.53
7,765,897 B2 * 8/2010 Kim ..... B25B 13/14 81/159
7,997,168 B2 * 8/2011 Kinskey ..... B25B 13/463 81/163
2006/0225539 A1 10/2006 Chen
2013/0255060 A1 10/2013 Johnson

OTHER PUBLICATIONS

International Preliminary Report on Patentability of relevant PCT application No. PCT/ES2014/000114 dated Jan. 10, 2017.

* cited by examiner

HINGED RATCHET WRENCH

RELATED APPLICATION

This application is the US national phase application of international application number PCT/ES2014/000114, filed 7 Jul. 2014, which designates the US and the contents of which are hereby incorporated by reference as if set forth in their entirety.

FIELD OF THE ART

The present invention in general relates to a ratchet wrench and, more particularly, to a wrench that comprises a functional head and a handle connected to each other capable of relative rotation around a hinge axis, a ratchet mechanism associated with said hinge axis and a releasing mechanism operable to release the hinge from said ratchet mechanism.

BACKGROUND OF THE INVENTION

Document ES 0215567 A3 relates to a ratchet wrench that comprises a head provided with a pair of clamps, a handle connected to the head capable of relative rotation around a hinge axis, and a ratchet mechanism that includes a ratchet wheel section coaxial to said hinge axis, integrally formed with the head body and provided with circumferential teeth along part of a peripheral edge thereof, a ratchet pawl movably installed on the handle, and an elastic element which biases said ratchet pawl against said circumferential teeth of the ratchet wheel. The wrench additionally includes a releasing member movably installed on the handle and linked to the ratchet pawl so that when the releasing member is manually moved from a rest position to a release position, the ratchet pawl is disengaged from the ratchet wheel against the bias of said elastic working element.

A drawback of the ratchet wrench from the referenced document ES 0215567 A3 is that the releasing member is rigidly connected to the ratchet pawl, and, consequently, the movements that the ratchet pawl inevitably experiences when, during its operation, it jumps from one tooth to another of the circumferential teeth of the ratchet wheel, are transmitted to the releasing member, which can cause unnecessary noise and inconvenience to the user that is gripping the tool by the handle. Another drawback is that the ratchet pawl is provided with guided linear movements in a direction aligned with the hinge axis and has a single tooth that engages the circumferential teeth of the ratchet wheel in a radial direction, which is hardly prone to resisting the tangential stresses experienced by the ratchet mechanism when operating in the retention direction.

Document US 20060225539 A1 relates to a wrench provided with a handle attached to a head with two movable clamps through a driving mechanism that comprises a driving screw rotatably mounted on the head body and provided with two externally threaded portions with opposite threading directions respectively engaged to corresponding internally threaded holes with opposite threading directions formed on both clamp bodies, respectively. On both ends of the driving screw respective gripping elements are fixed arranged in positions accessible to be gripped and turned by a user.

A drawback of the wrench from referenced document US 20060225539 A1 is that the material of both clamp bodies surrounding by 360° the respective internally threaded holes occupies a relatively large space in the head body, and this space, in case one wishes to connect the handle with the head by means of a ratchet mechanism, it would force one to provide a ratchet wheel with a relatively small diameter or to place the hinge axis relatively far from the clamps, both options being unfavourable as regards the mechanical performance of the components and the versatility of the tool. Another drawback is that it includes a retention device located in a central position that prevents the complete closure of the clamps.

DISCLOSURE OF THE INVENTION

The present invention contributes to alleviate the above and other drawbacks by providing a ratchet wrench that comprises a functional head and a handle connected to each other capable of relative rotation around a hinge axis, and a ratchet mechanism between the handle and the functional head. Said ratchet mechanism comprises a ratchet wheel coaxial with said hinge axis, rigidly attached to the functional head and provided with circumferential teeth along at least part of a peripheral edge thereof, a ratchet pawl movably installed on the handle, and an elastic working element which biases said ratchet pawl to an engaged position against said circumferential teeth of said ratchet wheel.

The ratchet wrench of the present invention additionally comprises a releasing member and a locking element. Said releasing member is movably installed on the handle and is manually operable. A return elastic element permanently biases the releasing member to a rest position. Said locking element is also movably installed on the handle and is manually operable to move between a rest position, in which said locking element does not interfere with the ratchet pawl, and a locking position, in which the locking element contacts the ratchet pawl, holding it in said engaged position with the ratchet wheel.

In one embodiment, the locking element is slidingly installed in a cavity of the handle and has a protrusion that fits in a first recess of said cavity when the locking element is in said rest position and in a second recess of said cavity when the locking element is in said locking position. The locking element has, for example, the shape of an elongated rod with a contour defining the protrusion, and the protrusion is pushed against the first and second cavity recesses as a result of some elasticity of the locking element in cooperation with the configuration of the cavity.

Optionally, said releasing member is linked to the ratchet pawl by means of a unidirectional actuation kinematic chain, which, when the releasing member is manually moved from said rest position to a release position, it positively acts to transmit the movement of the releasing member to the ratchet pawl, resulting in a movement of the ratchet pawl to a position out of engagement with the ratchet wheel against the bias of said elastic working element. Instead, when the releasing member is returned and held in the rest position by said elastic return element, said unidirectional actuation kinematic chain does not act and the interaction between the releasing member and the ratchet pawl is interrupted, which prevents that movements experienced by the ratchet pawl, when it jumps from a tooth to the next of the circumferential teeth of the ratchet wheel during its operation, be transmitted to the releasing member.

In one embodiment, the ratchet pawl is installed on the handle so that it can pivot around a pivoting axis parallel to the hinge axis and it has at least one or more restraining teeth that fit with the circumferential teeth of the ratchet wheel. Preferably, the arrangement of the ratchet pawl and of its pivoting axis relative to the ratchet wheel and the hinge axis is such that the geometric plane that contains said pivoting axis and that goes approximately through the centre of the restraining tooth or of that of the restraining teeth farthest from the pivoting axis is a substantially tangential plane to the circumferential teeth of the ratchet wheel.

Preferably, the ratchet pawl is installed on the handle between the ratchet wheel and the releasing member. However, the unidirectional actuation kinematic chain allows two alternative opposite embodiments. In the first embodiment, the unidirectional actuation kinematic chain acts on compression but not on traction; in other words, it is capable of pushing but is not capable of pulling. In a second embodiment, the unidirectional actuation kinematic chain acts on compression; in other words, it is capable of pulling but is not capable of pushing.

In the first embodiment, the releasing member is farther away from the hinge axis when it is in the rest position than when it is in the release position, so that, for it to be moved from the rest position to the release position, it must be manually displaced bringing it closer to the hinge axis against the bias of the elastic return element, thereby the unidirectional actuation kinematic chain pushing the ratchet pawl out of engagement with the ratchet wheel against the bias of the elastic working element. When the releasing member is released, the elastic return element returns it to the rest position at the same time as the elastic working element moves the ratchet pawl back into engagement with the ratchet wheel.

However, since in this first embodiment the unidirectional actuation kinematic chain is not capable of pulling, the unidirectional actuation kinematic chain does not transmit the movements experienced by the ratchet pawl to the releasing member as it jumps from one tooth to another of the circumferential teeth of the ratchet wheel during the escape operation of the ratchet mechanism.

In the second alternative embodiment, the releasing member is closer to the hinge axis when it is in the rest position than when it is in the release position, so that for it to be moved from the rest position to the release position it must be manually displaced away from the hinge axis against the bias of the elastic return element, thereby the unidirectional actuation kinematic chain pulling the ratchet pawl out of engagement with the ratchet wheel against the bias of the elastic working element. When the releasing member is released, the elastic return element returns it to the rest position at the same time as the elastic working element moves the ratchet pawl back into engagement with the ratchet wheel.

However, since in the second embodiment the unidirectional actuation kinematic chain is not capable of pushing, the unidirectional actuation kinematic chain does not transmit the movements experienced by the ratchet pawl to the releasing member as it jumps from one tooth to another of the circumferential teeth of the ratchet wheel during the escape operation of the ratchet mechanism.

The first embodiment comprises a pushing member installed on the handle so that it may pivot around a pivoting axis and a pushing rod that has an end linked to the releasing member and another end linked to said pushing member, and said unidirectional actuation kinematic chain includes a simple push contact between the pushing member and the ratchet pawl only when the pushing member is pivoted by the pushing rod as a result of the movement of the releasing member from the rest position to the release position.

In contrast, when the releasing member is returned to the rest position by the elastic return element, the ratchet pawl is returned to the working position by the elastic working element, but since the push contact between the pushing member and the ratchet pawl is interrupted, the movements experienced by the ratchet pawl, which is normally biased into engagement with the ratchet wheel by the elastic working element, in its interaction with the ratchet wheel, are not transmitted to the releasing member.

In the second embodiment, the unidirectional actuation kinematic chain comprises a connecting rod that has an end hingedly connected to the releasing member by a pivoting juncture and another end hingedly connected to the ratchet pawl by a pivoting and sliding juncture, so that the connecting rod pulls the ratchet pawl away from the ratchet wheel only when the releasing member is manually moved from the rest position to the release position.

In contrast, when the releasing member is returned to the rest position by the elastic return element, the ratchet pawl is returned to the working position by the elastic working element, but since the pin can be freely moved relative to the ratchet pawl by virtue of said pivoting and sliding juncture, the interaction between the connecting rod and the ratchet pawl is interrupted, so that the ratchet pawl, which is normally biased into engagement with the ratchet wheel by the elastic working element, can experience the movements caused by the interaction with the toothed wheel, these movements not being transmitted to the releasing member.

The functional head can be of different types. In an embodiment, the functional head comprises a head body, two movable clamp bodies installed on said head body so that they can move along a clamp guide arranged in a direction perpendicular to the hinge axis, and a driving mechanism installed on the head body and connected to the clamp bodies so that the driving mechanism, when it is manually operated, moves said clamp bodies in opposite directions towards or away from each other, thereby adjusting the spacing between mutually opposed clamp surfaces of the clamp bodies.

In one embodiment, said driving mechanism comprises a driving screw rotatably mounted on the head body, arranged in a position parallel to said clamp guide and placed between the clamp guide and the hinge axis. This driving screw has two externally threaded portions with opposite threading directions, which are engaged to corresponding internally threaded sections with opposite threading directions formed on the clamp bodies, respectively.

Said internally threaded sections of the clamp bodies do not completely surround the driving screw, but only encompass certain angle, for example an angle equal to or less than 180°, about the driving screw. This implies a significant reduction of the space occupied by the driving mechanism compared with other prior art devices, which permits the installation of a ratchet wheel of larger diameter and/or reduce the distance between the hinge axis and the driving screw, thereby favouring the mechanical performance of the components and the versatility of the tool.

In another alternative embodiment, the driving mechanism comprises a threaded stem rigidly attached to one of the clamp bodies or integrally formed therewith, an internally threaded section rigidly attached to the other of the clamp bodies or integrally formed therewith, and a driving sleeve rotatably mounted but not axially displaceable on the head body. Said threaded stem is parallel to the clamp guide and has a first threading direction, said internally threaded section is likewise parallel to the clamp guide and has a second threading direction opposite to said first threading direction, and said driving sleeve has an internally threaded hole that has said first threading direction and an external thread that has said second threading direction. The internal thread of the driving sleeve engages the threaded stem of one of the clamp bodies and said external thread of the driving sleeve engages the internally threaded section of the other of the clamp bodies.

The internally threaded section of the other of the clamp bodies only encompasses certain angle, for example an angle equal to or less than 180°, around the driving sleeve, which implies a significant reduction of the space occupied by the driving mechanism compared with other prior art devices, and allows the installation of a ratchet wheel of larger diameter and/or the reduction of the distance between the hinge axis and the driving screw, thereby favouring the mechanical performance of the components and the versatility of the tool.

In another alternative embodiment, the functional head comprises a tube wrench, and in yet another alternative embodiment the functional head comprises an adjustable nut wrench with a fixed jaw and a movable jaw.

BRIEF DESCRIPTION OF THE DRAWINGS

The above and other features and advantages will be more apparent from the following detailed description of a number of embodiment examples with reference to the attached drawings, in which.

DETAILED DESCRIPTION OF EXEMPLARY EMBODIMENTS

Figure 1:
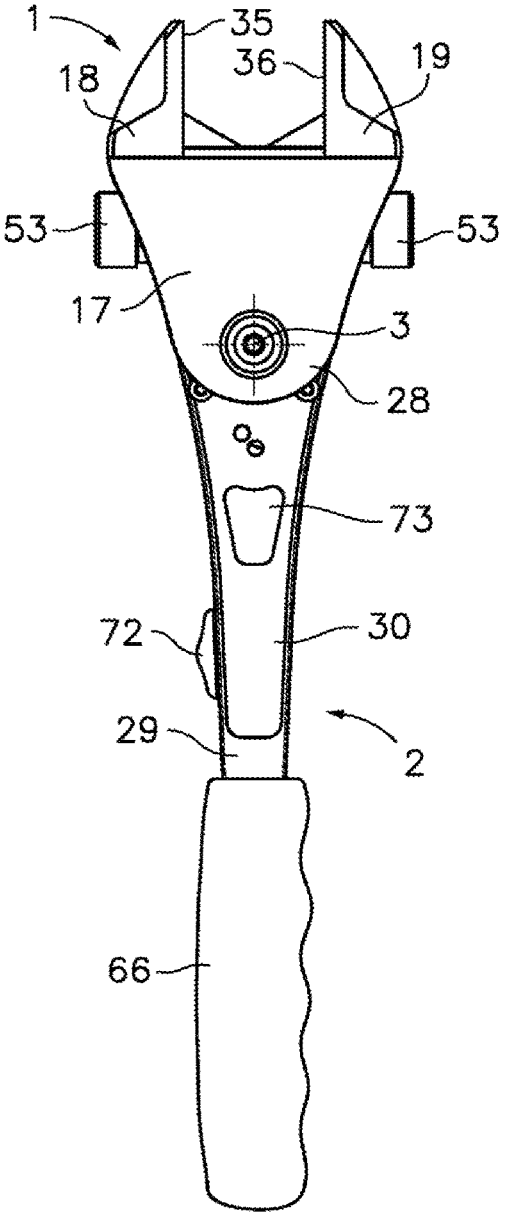
FIG. 1 is a front view of a ratchet wrench according to one embodiment of the present invention, including a functional head and a handle mutually related by a ratchet mechanism.
Figure 2:
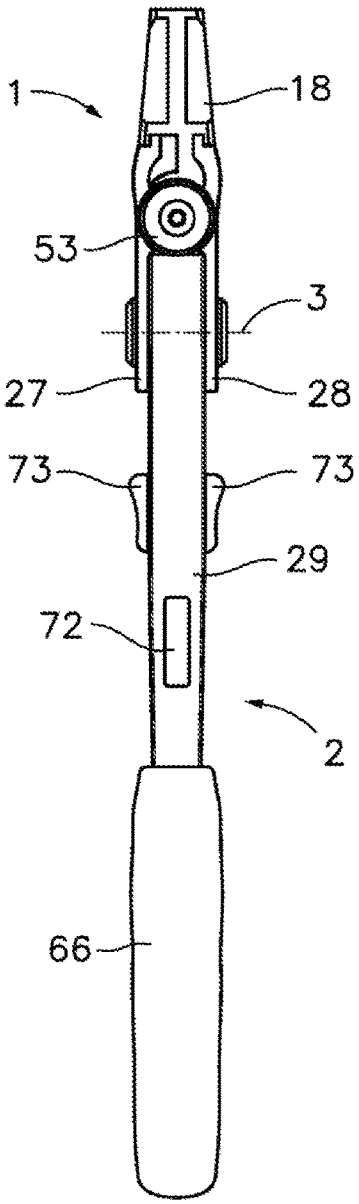
FIG. 2 is a side view of the ratchet wrench of FIG. 1.

With reference first to FIGS. 1 and 2, a ratchet wrench according to one embodiment of the present invention is shown therein, which comprises a functional head 1 and a handle 2 connected to each other capable of relative rotation around a hinge axis 3 in cooperation with a ratchet mechanism that will be described in detail hereinbelow.

Handle 2 comprises a handle body 29 that has a flattened region on an end with one or more housings in which several elements of the ratchet mechanism are housed, and a lid 30 fixed to said handle body 29 closing said housings. On another opposite end of the handle 2 there is a handgrip 66 ergonomically configured to be gripped by hand. In the handle 2 there are also movably installed releasing buttons 73 accessible from both sides of the flattened region and a locking button 72 accessible from a side edge of the flattened region. Any of said releasing buttons 73 is manually operable to release the ratchet mechanism and said locking button 72 is manually operable to lock the ratchet mechanism, as will be described hereinbelow. Alternatively, handle 2 can include two or more lids 30 fixed to the handle body 29 to close the housings depending on the shape and arrangement of the housings.

The functional head 1 comprises a head body 17 that has two mutually opposed lugs 27, 28 between which said flattened region of the handle end 2 is housed. In the embodiment shown in FIGS. 1 and 2, the functional head 1 comprises two movable clamp bodies 18, 19 installed on the head body 17, and said clamp bodies 18, 19 have mutually opposed clamp surfaces 35, 36. This and other embodiments of the functional head will be described in detail hereinbelow.

FIGS. 3 to 8 show a ratchet mechanism according to a first embodiment that comprises a ratchet wheel 4 coaxial with said hinge axis 3 housed in a housing of the handle body 29 in the flattened region of the handle end 2 covered by the lid 30. The ratchet wheel 4 has circumferential teeth **4*a*** formed along a peripheral edge thereof.

Figure 7:
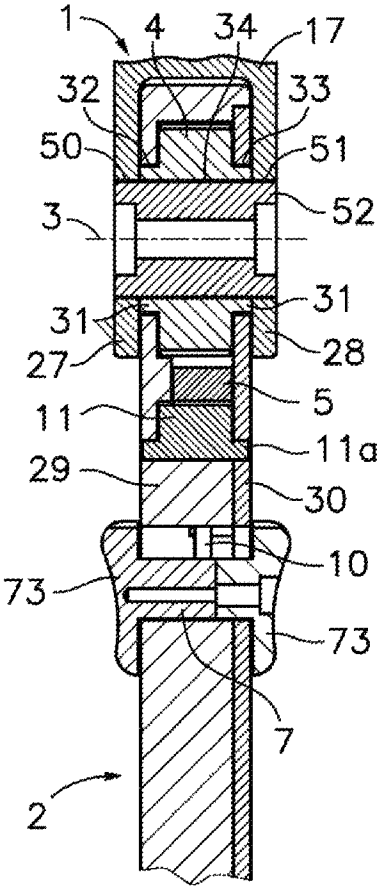
FIG. 7 is a cross-sectional view taken along a plane VII-VII in FIG. 6 including, in addition, a grooved ratchet shaft.
Figure 6:
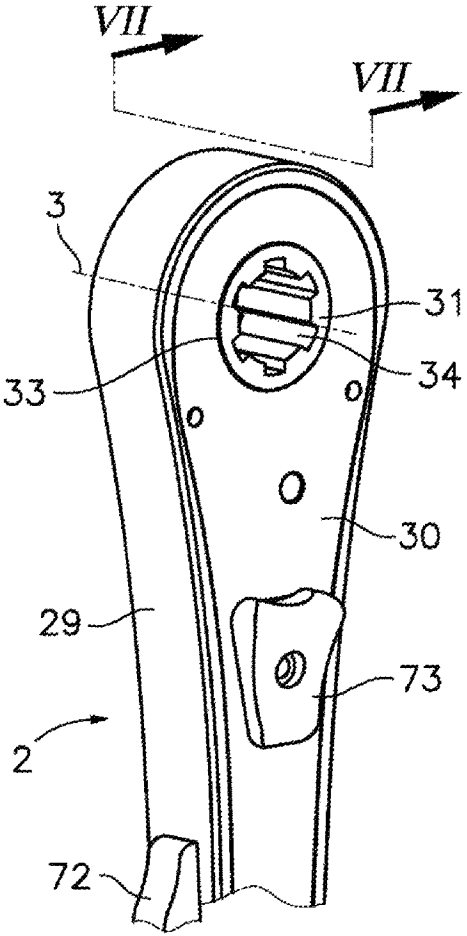
FIG. 6 is a partial perspective view of a handle end where the ratchet mechanism of FIGS. 3, 4 and 5 is housed.

As is shown in FIGS. 6 and 7, from the sides of the ratchet wheel 4 cylindrical hub portions 31 protrude that are inserted and rotatably guided in respective guide holes 32, 33 formed on said handle body 29 and on the lid 30, respectively. However, the ratchet wheel 4 is rigidly attached to the functional head 1 by means of a grooved ratchet shaft 52 (FIG. 8) inserted through grooved holes 50, 51 formed on the lugs 27, 28 of the head body 17 and through a grooved axial hole 34 formed on the ratchet wheel 4, which prevents the relative rotation between the ratchet wheel 4 and the head body 17.

The handle body 29 has other housings covered by the lid 30 in which a ratchet pawl 5 and a releasing member 7 are housed. Said releasing member 7 is connected to the releasing buttons 73 through openings formed on the handle body 29 and on the lid 30. In the embodiment shown in FIG. 7, said releasing member 7 and one of the releasing buttons 73 are formed by a first piece and the other releasing button 73 is formed by a second piece fixed to the first by means of a screw.

Said ratchet pawl 5 has several restraining teeth 5*a* meshed with the circumferential teeth 4*a* of the ratchet wheel 4, and is installed on the handle 2 between the ratchet wheel 4 and the releasing member 7 so that it can pivot around a pivoting axis 9 parallel to the hinge axis 3 between a working position (FIG. 3), in which the restraining teeth 5*a* of the ratchet pawl 5 are engaged with the circumferential teeth 4*a* of the ratchet wheel 4, and a release position (FIG. 4), in which the restraining teeth 5*a* of the ratchet pawl 5 are disengaged from the circumferential teeth 4*a* of the ratchet wheel 4. An elastic working element 6, such as a helical spring arranged on compression between the handle body 29 and the ratchet pawl, permanently biases the ratchet pawl 5 towards the working position (FIG. 3) against the ratchet wheel 4.

Figure 3:
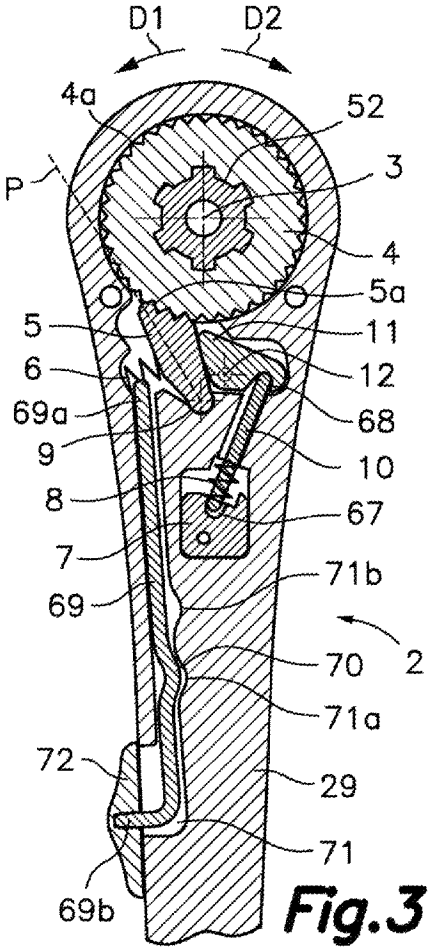
FIG. 3 is a front view of the ratchet mechanism of FIG. 3 in a working position.
Figure 4:
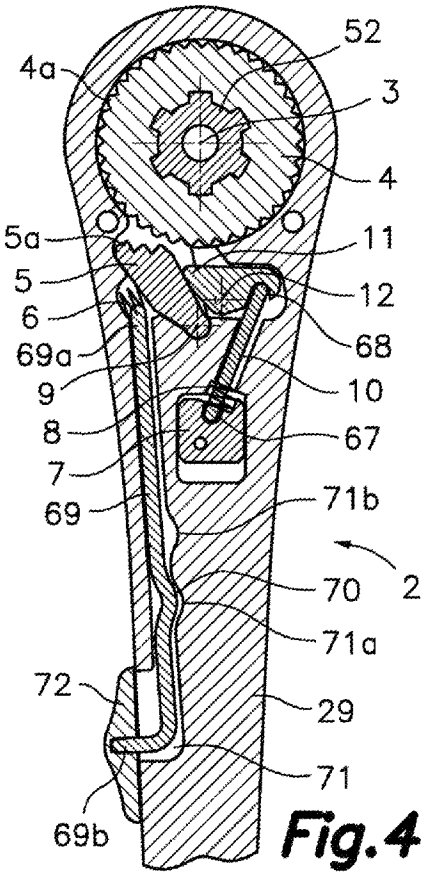
FIG. 4 is a front view of the ratchet mechanism of FIG. 3 in a release position.
Figure 5:
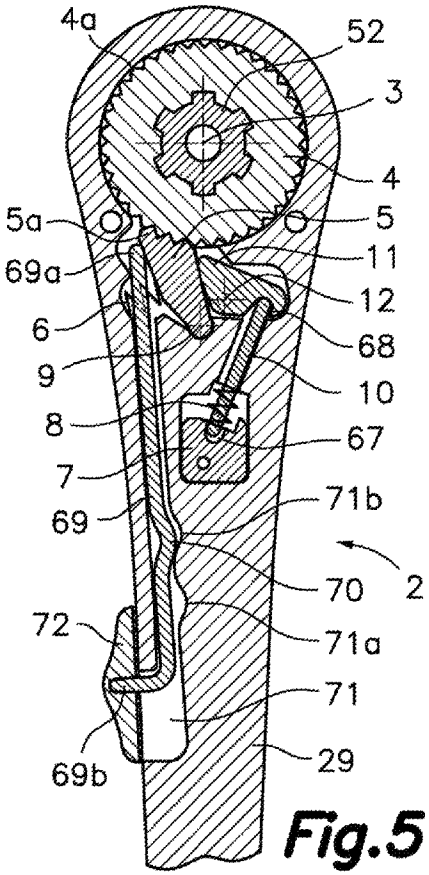
FIG. 5 is a front view of a ratchet mechanism of the wrench of FIGS. 1 and 2 according to a first alternative embodiment thereof in a locking position.
Figure 8:
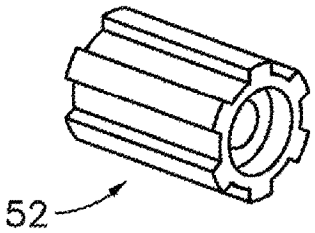
FIG. 8 is a perspective view of the grooved ratchet shaft.

In the example illustrated in FIGS. 3 to 5, the pivoting axis 9 of the ratchet pawl 5 is determined by a partially cylindrical end of the ratchet pawl 5 rotatably received in a combined partially cylindrical recess formed in the housing of the handle body 29.

The arrangement of the ratchet pawl 5 relative to the ratchet wheel 4 is such that a geometrical plane P (FIG. 3) that contains said pivoting axis 9 and that goes through said restraining teeth 5*a*, or more specifically through the restraining tooth 5*a* farthest from the hinge axis 3, is a plane substantially tangential to the circle of the circumferential teeth 4*a* of the ratchet wheel 4. Consequently, when in is intended that the functional head 1 rotate along with the ratchet wheel 4 in a first direction D1 (FIG. 3) relative to the handle 2, the restraining teeth 5*a* of the ratchet pawl 5 are restrained in the circumferential teeth 4*a* of the ratchet wheel 4, preventing the relative rotation. In contrast, if the functional head 1 is made to rotate along with the ratchet wheel 4 in a second direction D2 (FIG. 3) relative to the handle 2, the restraining teeth 5*a* of the ratchet pawl 5 jump from one tooth to another of the circumferential teeth 4*a* of the ratchet wheel 4 allowing the relative rotation.

The releasing member 7 is linked to the ratchet pawl 5 by a unidirectional actuation kinematic chain that includes a pushing member 11 and a pushing rod 10 arranged in other housings of the handle body 29 covered by the lid 30. Said pushing member 11 is installed in a position adjacent to the ratchet pawl 5 so that it can pivot around a pivoting axis 12, while the releasing member 7 is installed on the handle 2 in a relatively distant position of the ratchet pawl 5 and is guided so that it can slide in a direction substantially aligned with a geometric plane that contains the hinge axis 3.

In this example, the pivoting axis 12 of the pushing member 11 is determined by trunnions 11*a* (FIG. 7) protruding from opposite sides of the pushing member 11 inserted in corresponding holes of the handle body 29 and the lid 30.

The releasing member 7 may be moved in its housing between a rest position (FIG. 3) and a release position (FIG. 4). The releasing member 7 is farther from the hinge axis 3 in the rest position than in the release position. An elastic return element 8, such as a helical spring, permanently biases the releasing member 7 against the rest position.

The pushing rod 10 has an end slidingly and loosely inserted in a gap 67 formed on the releasing member 7 and another opposite end that is slidingly and loosely inserted in a gap 68 formed on the pushing member 11. Said elastic return element 8 is arranged on compression between a surface of the handle body 29 and the releasing member 7 and is wound around the pushing rod 10.

Thus, when the releasing member 7 is manually moved from the rest position (FIG. 3) to the release position (FIG. 4) against the bias of the elastic return element 8, the releasing member 7 pushes the pushing rod 10 and this, in turn, pushes the pushing member 11, making it pivot around the pivoting axis 12, whereby the pushing member 11 establishes a push contact against the ratchet pawl 5 and it makes the ratchet pawl 5 pivot around the pivoting axis 9 towards the release position against the bias of the elastic working element 6. While the releasing member 7 is manually held in the release position, the ratchet pawl 5 is also held in its release position and the functional head 1 can freely rotate relative to the handle 2.

When the releasing member 7 is released, the elastic working element 6 moves the ratchet pawl 5 back to its working position and the elastic return element 8 moves the releasing member 7 back to its rest position. However, by virtue of the simple push contact in the unidirectional actuation kinematic chain that links the releasing member 7 and the ratchet pawl 5, movements experienced by the ratchet pawl 5 when the restraining teeth 5*a* of the ratchet pawl 5 jump from one tooth to another of the circumferential teeth 4*a* of the ratchet wheel 4 as the functional head 1 rotates in the second direction D2 relative to the handle 2, are not transmitted to the releasing member 7, which is held static in its rest position by the elastic return element 8.

The handle body 29 has an elongated cavity formed, between the housing of the releasing member 7 and a side edge of the handle body 29, that in its end closest to the hinge axis 3 communicates with the housing of the ratchet pawl 5 and in its end farthest from the hinge axis 3 communicates with the exterior through an opening formed on said side edge of the handle body 29. Said cavity 71 is also covered by the lid 30. In the cavity 71 a locking element 69 of elongated configuration is slidingly installed, which has a contacting end 69*a* adjacent to the housing of the releasing member 7 and an actuation end 69*b* connected to the previously mentioned locking button 72 through said opening on the side edge of the handle body 29.

Said locking element 69 is manually operable by means of the locking button 72 between a rest position (FIGS. 3 and 4), in which the locking element 69 does not interfere with the ratchet pawl 5, and a locking position (FIG. 5), in which said contacting end 69*a* of the locking element 69 contacts the ratchet pawl 5 holding it in said engaged position with the ratchet wheel 4.

The locking element 69 has a protrusion 70, and the cavity 71 has a first recess 71*a* and a second recess 71*b*. Said protrusion 70 of the locking element 69 fits in said first recess 71*a* of the cavity 71 when the locking element 69 is in said rest position (FIGS. 3 and 4) and the protrusion 70 of the locking element 69 fits in said second recess 71*b* of the cavity 71 when the locking element 69 is in said locking position (FIG. 4). In the illustrated example, the locking element 69 is formed from a metal rod which has an end that defines a contacting end 69*a*, a contour that defines the protrusion 70 and a bend that defines the actuation end 69*b*, and the protrusion 70 is pushed against the first and second recesses 71*a*, 71*b* of the cavity 71 as a result of some elasticity of said metal rod in cooperation with an adequate configuration of the cavity 71.

When the locking element 69 is held in the locking position by the engagement of the protrusion 70 in the second recess 71*b* of the cavity 71, the action of the ratchet mechanism is cancelled and the functional head 1 is secured with the handle 2. This option is useful, for instance, in those jobs in which repeated engaging and disengaging operations of the wrench relative to a nut are required, for example, applying moderate force.

Figure 10:
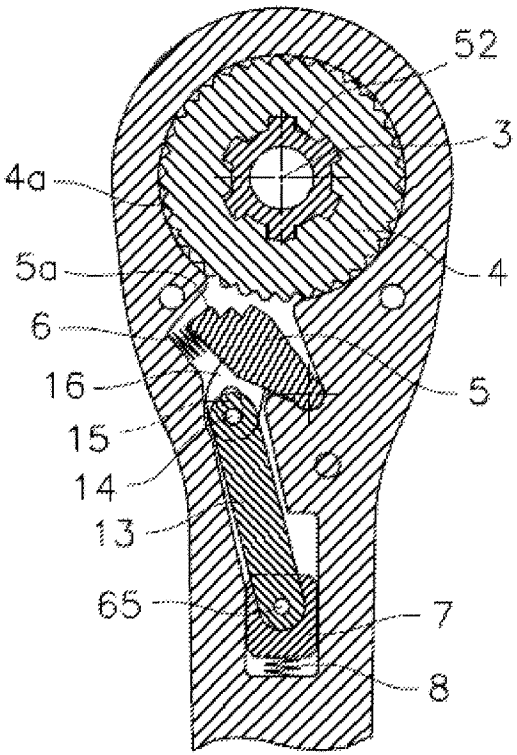
FIG. 10 is a front view of the ratchet mechanism of FIG. 9 in a release position.
Figure 9:
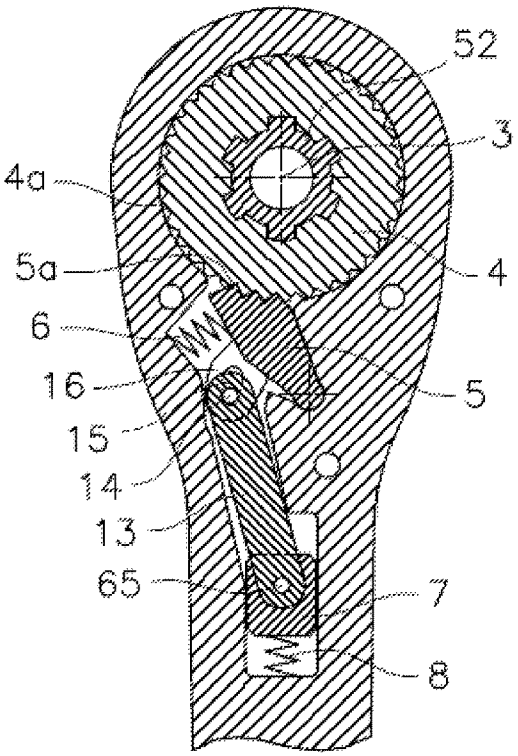
FIG. 9 is a front view of a ratchet mechanism according to a second alternative embodiment thereof in a working position.

FIGS. 9 and 10 show a second embodiment of the ratchet mechanism, wherein the ratchet wheel 4, the ratchet pawl 5 and the elastic working element 6 are configured and arranged in a way similar to the first embodiment described above in connection with FIGS. 3, 4 and 5. The releasing member 7 is also slidingly installed on the handle 2, although, in contrast with the first embodiment, in this second embodiment the releasing member 7 is closer to the hinge axis 3 in the rest position than in the release position, and the elastic return element 8 is arranged in an opposite position so as to bias the releasing member 7 to the rest position.

In the second embodiment, the unidirectional actuation kinematic chain that links the releasing member 7 with the ratchet pawl 5 comprises a connecting rod 13 that has a first end linked to the releasing member 7 by a pivoting juncture that comprises, for example, a first pin 65 attached to the connecting rod 13 and inserted in a cylindrical hole of the releasing member 7, and a second end linked to the ratchet pawl 5 by a pivoting and sliding juncture that comprises, for example, a second pin 14 attached to the connecting rod 13 and inserted in an elongated hole 15 formed in an appendage 16 of the ratchet pawl 5. It will be understood that a reverse construction, that is, with said first pin 65 attached to the releasing member 7 and inserted in a cylindrical hole of the connecting rod 13 and/or with said second pin 14 attached to the appendage 16 of the ratchet pawl 5 and inserted in an elongated hole formed on the connecting rod 13, would provide an equivalent result and would be within the scope of the present invention.

Thus, when the releasing member 7 of the second embodiment is manually moved from the rest position (FIG. 9) to the release position (FIG. 10) against the bias of the elastic return element 8, the releasing member 7 pulls the connecting rod 13 and this, in turn, pulls the appendage 16 of the ratchet pawl 5 and makes it pivot around the pivoting axis 9 towards the release position against the bias of the elastic working element 6, which permits the free rotation of the functional head 1 relative to the handle 2 while the releasing member 7 is manually held in the release position.

When the releasing member 7 is released, the elastic working element 6 moves the ratchet pawl 5 back to its working position and the elastic return element 8 moves the releasing member 7 back to its rest position. However, by virtue of the elongated hole 15 in the unidirectional actuation kinematic chain that links the releasing member 7 and the ratchet pawl 5, movements experienced by the ratchet pawl 5 when the restraining teeth 5*a* of the ratchet pawl 5 jump from one tooth to another of the circumferential teeth 4*a* of the ratchet wheel 4 as the functional head 1 rotates in the second direction D2 relative to the handle 2, are not transmitted to the releasing member 7, which is held static in its rest position by the elastic return element 8.

FIGS. 11 to 15 show a functional head 1 according to an embodiment thereof corresponding to the one shown in FIGS. 1 and 2, which comprises two movable clamp bodies 18, 19 installed on said head body 17 so that they can move along a clamp guide 21, 22 (FIG. 12) arranged in a direction perpendicular to the hinge axis 3. The functional head 1 includes a driving mechanism installed on the head body 17 and manually operable to move said clamp bodies 18, 19, which allows adjusting the spacing between mutually opposed clamp surfaces 35, 36 of the clamp bodies 18, 19.

The driving mechanism comprises a driving screw 20 parallel to said clamp guide 21, 22 rotatably mounted on the head body 17 and located between the clamp guide 21, 22 and the hinge axis 3. This driving screw 20 has two externally threaded portions 23, 24 with opposite threading directions and the clamp bodies 18, 19 have corresponding internally threaded sections 25, 26 formed with opposite threading directions respectively coupled to said two externally threaded portions 23, 24 of the driving screw 20.

Figure 12:
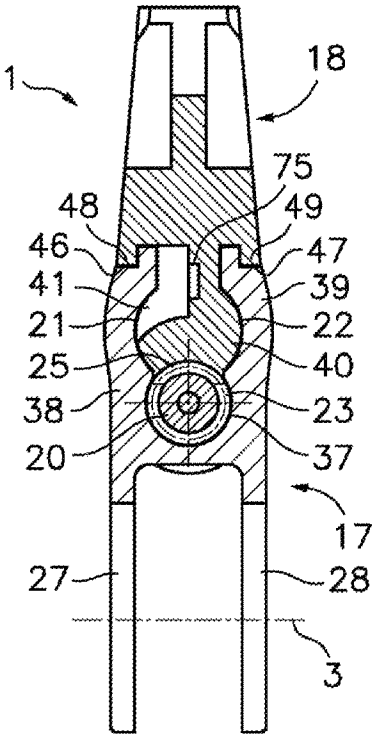
FIG. 12 is a cross-sectional view taken along the plane XII-XII in FIG. 11.
Figure 11:
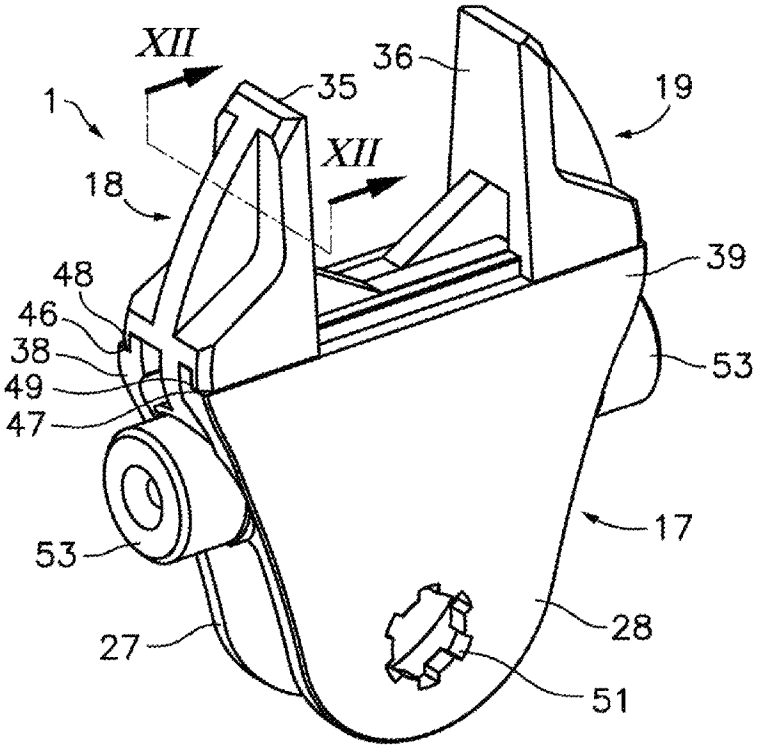
FIG. 11 is a perspective view of the functional head of the wrench of FIGS. 1 and 2.
Figure 13:
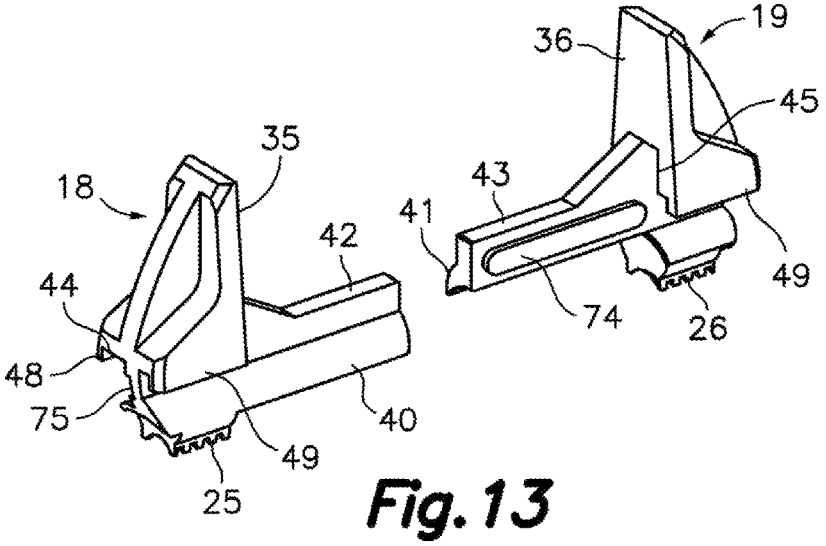
FIG. 13 is a perspective view of two clamp bodies of the head of FIGS. 11 and 12.
Figure 14:
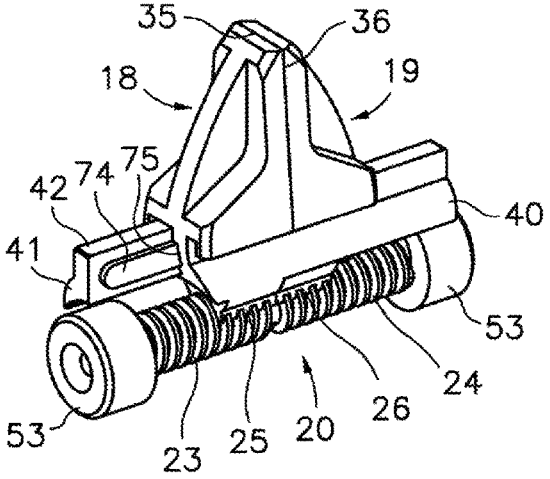
FIG. 14 is a perspective view of a driving screw in cooperation with both clamp bodies of FIG. 13 in a completely closed position.
Figure 15:
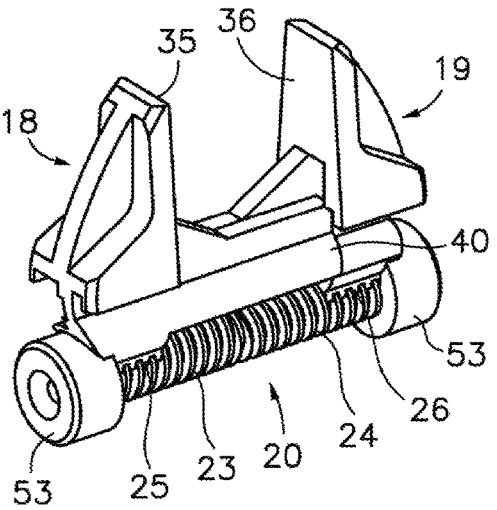
FIG. 15 is a perspective view of the driving screw in cooperation with both clamp bodies of FIG. 13 in a completely open position.

As is best shown in FIG. 12, the head body 17 comprises two side walls 38, 39 that have mutually opposed surfaces that cooperatively define with another part of the head body 17 a screw housing 37 sized to house and rotatably guide the driving screw 20. In said mutually opposed surfaces of the side walls 38, 39 respective channels are formed that jointly define the clamp guide 21, 22.

Each of the clamp bodies 18, 19 (FIG. 13) has a respective main guide follower portion 40, 41 that engages one of said channels that jointly define the clamp guide 21, 22 of the head body 17. Furthermore, each of the clamp bodies 18, 19 has a respective auxiliary guide follower portion 42, 43 that slidingly engages a corresponding slot of the auxiliary guide 44, 45 formed on the other of the clamp bodies 18, 19.

The auxiliary guide follower portions 42, 43 of the clamp bodies 18, 19 have respective mutually sliding surfaces located in a central plane perpendicular to the hinge axis 3, which slide in contact with each other when both clamp bodies 18, 19 are moved to adjust the spacing between the clamp surfaces 35, 36. One of the clamp bodies 19 has a rib 74 that protrudes from its corresponding sliding surface. This rib 74 is slidingly inserted in a slot 75 formed on the sliding surface of the other clamp body 18.

In the clamp bodies 18, 19 guide protrusions 48, 49 are also formed that slidingly engage corresponding longitudinal recesses 46, 47 (FIG. 12) formed on respective distal edges parallel to the clamp guide 21, 22 of the side walls 38, 39 of the head body 17. On each of ends of the driving screw 20 a gripping element 53 is fixed in a position accessible to be gripped and turned, and these gripping elements 53 act to axially retain the driving screw 20 in said screw housing 37.

Preferably, both clamp bodies 18, 19 are identical to each other, except for the existence of said rib 74 and slot 75 and for the fact that the respective internally threaded sections 25, 26 have opposite threading directions.

Thanks to the attachment and guidance of the clamp bodies 18, 19 in the head body 17 provided by the configuration of the clamp guide 21, 22 and of the main guide follower portions 40, 41 engaged therewith, it is not necessary for the internally threaded sections 25, 26 of the clamp bodies 18, 19 to completely surround the driving screw 20, but the latter only encompass an angle equal to or less than 180° about the driving screw 20. In the illustrated embodiment, the internally threaded sections 25, 26 encompass a 120° angle about the driving screw 20, which is enough to ensure the trailing of the clamp bodies 18, 19 and also allows for an extraordinarily compact design of the functional head 1.

The guide protrusions 48, 49 of the clamp bodies 18, 19 slidingly engaged in the longitudinal recesses 46, 47 of the head body 17 prevent the side walls 38, 39 of the head body 17 from being deformed and open outwardly due to the stresses to which they are exposed during the use of the ratchet wrench. The rib 74 and the slot 75 of the clamp bodies 18, 19, slidingly engaged to each other, contribute to minimize the bending tendency experienced by the auxiliary guide follower portions 42, 43 of the clamp bodies 18, 19 due to the stresses experienced during the use of the ratchet wrench.

Figure 16:
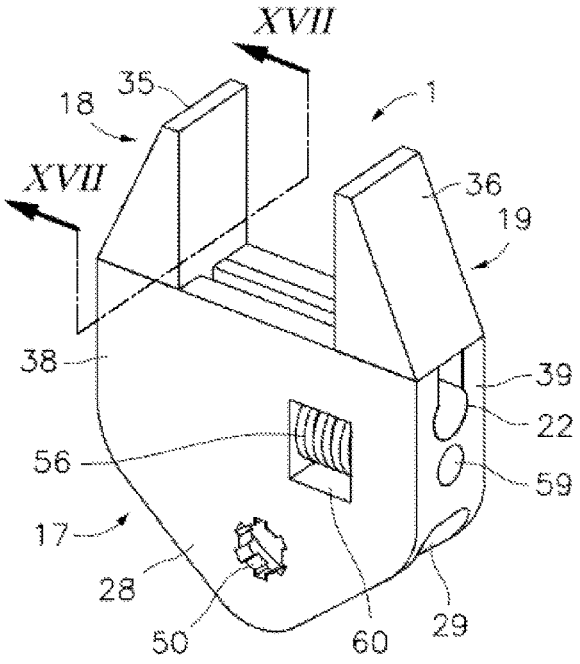
FIG. 16 is a perspective view of a functional head according to another alternative embodiment thereof.
Figure 17:
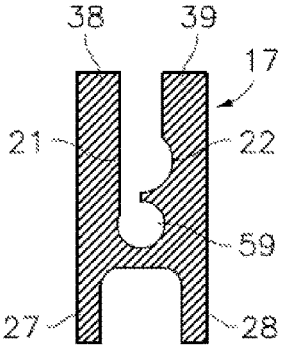
FIG. 17 is a cross-sectional view of a head body of the functional head of FIG. 15 taken along the plane XVII-XVII in FIG. 16.
Figure 18:
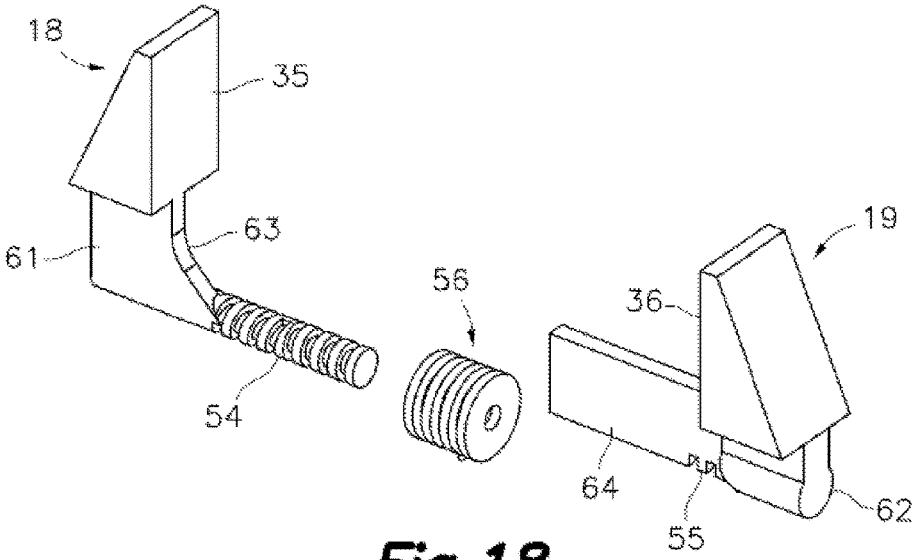
FIG. 18 is a perspective view of two clamp bodies and a driving sleeve of the functional head of FIG. 16.

FIGS. 16 to 18 show another alternative embodiment of the functional head 1, which comprises a head body 17 wherein first and second clamp bodies 18, 19 are installed that can be moved in a direction perpendicular to the hinge axis 3 along the clamp guide 21, 22 (FIG. 17) formed on the head body 17 by a driving mechanism.

The driving mechanism comprises a threaded stem 54 rigidly attached to said first clamp body 18. This threaded stem 54 is parallel to a clamp guide 21, 22 and has a first threading direction. The second clamp body 19 has a rigidly attached internally threaded section 55 parallel to the clamp guide 21, 22 and which has a second threading direction opposite to said first threading direction. In the head body 17, a driving sleeve 56 (best shown in FIG. 18) is rotatably but not axially displaceably mounted that has a hole with an internal thread 57 with said first threading direction engaged to said threaded stem 54 of the first clamp body 18, and an external thread 58 with said second threading direction engaged to said internally threaded section 55 of the second clamp body 19.

Said internally threaded section 55 of the second clamp body 19 only encompasses an angle equal to or less than 180°, for example 120°, around the driving sleeve 56, allowing for a compact design of the functional head 1.

As is best shown in FIG. 17, the head body 17 comprises two side walls 38, 39 with mutually opposed surfaces that, along with another part of the head body 17, define a stem housing 59 sized to house and axially guide the threaded stem 54. These mutually opposed surfaces of the side walls 38, 39 respectively include a flat face and a channel that jointly define the clamp guide 21, 22. The head body 17 also comprises a sleeve housing 60 in the shape of a through-passage in a direction perpendicular to the clamp guide 21, 22 and which intersects both the stem housing 59 and the clamp guide 21, 22.

The clamp bodies 18, 19 (best shown in FIG. 18) have respective main guide follower portions 61, 62 that engage said flat face and said channel, respectively, that jointly define the clamp guide 21, 22 of the head body 17 and respective flat auxiliary guide portions 63, 64 that slidingly engage each other.

Figure 19:
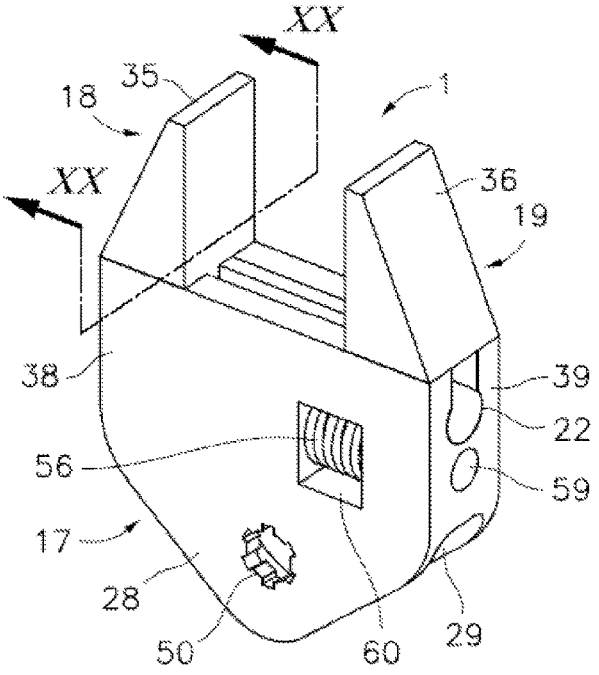
FIG. 19 is a perspective view of a functional head according to yet another alternative embodiment thereof.
Figure 20:
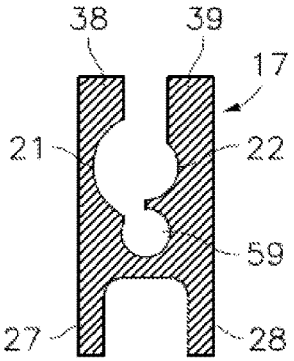
FIG. 20 is a cross-sectional view of a head body of the functional head of FIG. 19 taken along the plane XX-XX in FIG. 19.
Figure 21:
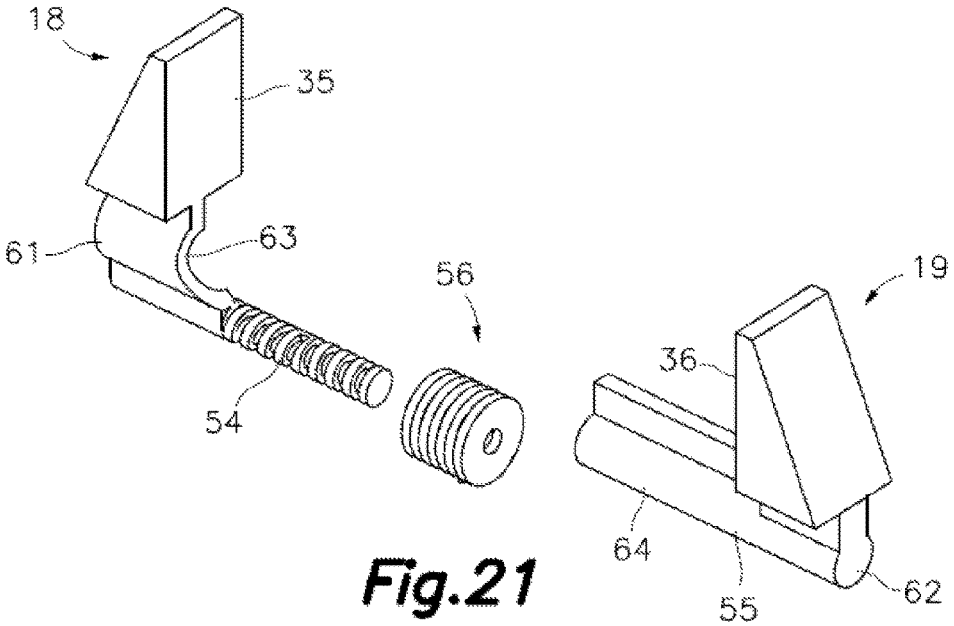
FIG. 21 is a perspective view of two clamp bodies and a driving sleeve of the functional head of FIG. 19.

FIGS. 19 to 21 show yet another alternative embodiment of the functional head 1, which is entirely analogous to the one described above in connection with FIGS. 16 to 18, except that, here, the mutually opposed surfaces of the side walls 38, 39 of the head body 17 (FIG. 20) comprise respective channels of different sizes, which jointly define the clamp guide 21, 22, and in which the first and second clamp bodies 18, 19 (best shown in FIG. 21) have respective convex main guide follower portions 61, 62 of different sizes that respectively engage said differently sized channels that jointly define the clamp guide 21, 22 of the head body 17.

Another different feature of the embodiment shown in FIGS. 19 to 21 is that the first clamp body 18 has a first concave auxiliary guide portion 63 while the second clamp body 19 has a second convex auxiliary guide portion 64 that slidingly engages said first auxiliary guide portion 63 of the first clamp body 18, thus contributing to better resist stresses in radial directions relative to the axis of the threaded stem 54.

Figure 22:
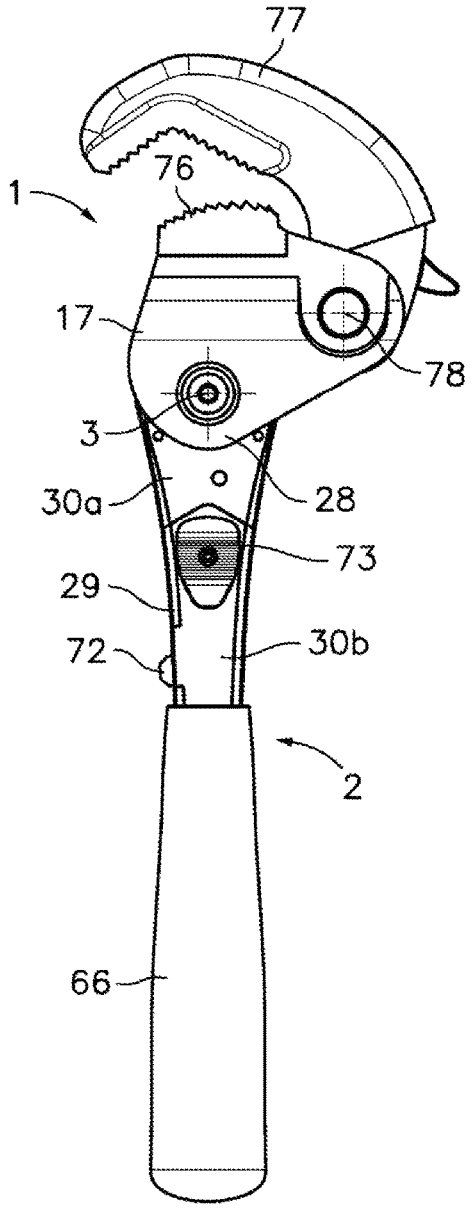
FIG. 22 is a front view of a ratchet wrench according to another alternative embodiment of the present invention, which includes a functional head that comprises a tube wrench.
Figure 23:
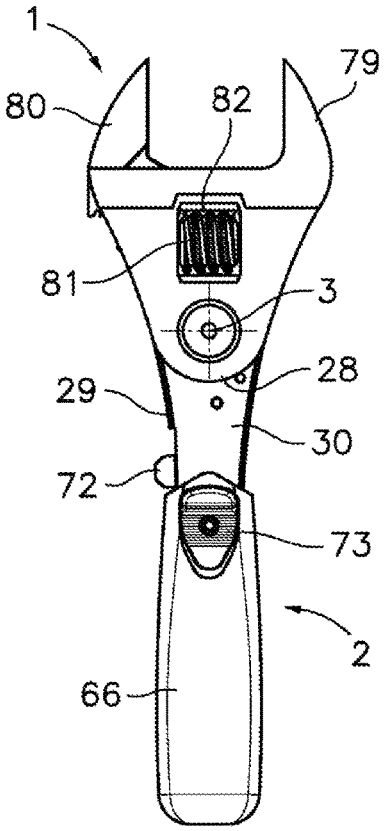
FIG. 23 is a front view of a ratchet wrench according to yet another alternative embodiment of the present invention, which includes a functional head that comprises an adjustable nut wrench with a fixed jaw and a movable jaw.

FIGS. 22 and 23 show ratchet wrenches according to two further alternative embodiments of the present invention, which include a functional head 1 and a handle 2 connected to each other capable of relative rotation around a hinge axis 3 in cooperation with a similar ratchet mechanism to the one described above in connection with FIGS. 1 to 10. However, in the ratchet wrench of FIG. 22 the functional head 1 comprises a tube wrench and in the ratchet wrench of FIG. 23 the functional head 1 comprises an adjustable nut wrench.

The tube wrench included in the functional head 1 of the ratchet wrench of FIG. 22 comprises a fixed jaw 76 integral with the head body 17 and a movable jaw 77 connected to the head body 17 so that it can freely pivot around a pivoting axis 78 parallel to the hinge axis 3 so that it can come closer to or away from the fixed jaw 76. The fixed and movable jaws 76, 77 have respective mutually opposed toothed surfaces. The toothed surface of the fixed jaw 76 is inscribed in a convex curved surface, while the toothed surface of the movable jaw 77 includes two inscribed sections in two planes that form an obtuse angle to each other.

The adjustable nut wrench included in the functional head 1 of the ratchet wrench of FIG. 23 comprises a fixed jaw 79 integral with the head body 17 and a movable jaw 80 connected to the head body 17 by means of linear guides. The fixed and movable jaws 79, 80 have respective mutually parallel and opposed smooth surfaces. In the head body 17, an endless toothed wheel 81 is rotatably installed that meshes with corresponding teeth 82 formed on the movable jaw 80. The endless toothed wheel 81 can be manually driven to bring the movable jaw 80 closer to or away from the fixed jaw 79.

In both alternative embodiments of FIGS. 22 and 23, the head body 17 has two mutually opposed lugs 27, 28 between which the flattened region of the handle end 2 is housed that supports the hinge axis 3, and where the ratchet mechanism is arranged according to what has been described above in connection with FIGS. 1 to 10. The handle 2 comprises a handle body 29 that has one or more housings in which there are housed several elements of the ratchet mechanism, a lid 30 that closes said housings, a locking button 72, a releasing button 73 and a handgrip 66. The handle 2 of the ratchet wrench of FIG. 22 has two lids 30*a*, 30*b* instead of one single lid.

The scope of the present invention is defined in the appended claims.

The invention claimed is:

1. A ratchet wrench that comprises:

a functional head and a handle connected to each other capable of relative rotation around a hinge axis;

a ratchet wheel coaxial with said hinge axis, rigidly attached to the functional head and provided with circumferential teeth along at least part of a peripheral edge thereof;

a ratchet pawl movably installed on the handle and provided with at least a restraining tooth engageable to said circumferential teeth of the ratchet wheel;

an elastic working element that biases said ratchet pawl to an engaged position with said circumferential teeth of said ratchet wheel;

a releasing member movably installed on the handle and manually operable between a rest position and a release position; and a kinematic chain arranged between said releasing member and said ratchet pawl, wherein said kinematic chain transforms a movement of the releasing member from said rest position to said release position into a movement of the ratchet pawl to a position out of engagement with the ratchet wheel against the bias of said elastic working element, characterised in that it further comprises:

a locking element movably installed on the handle, said locking element being manually operable between a rest position, in which the locking element does not interfere with the ratchet pawl, and a locking position, in which the locking element contacts the ratchet pawl, holding it in said engaged position with the ratchet wheel.

2. A ratchet wrench according to claim 1, wherein the locking element is slidingly installed in a cavity of the handle and has a protrusion, and said cavity has a first recess in which said protrusion fits when the locking element is in said rest position, and a second recess in which the protrusion fits when the locking element is in said locking position and wherein the locking element is formed from a metal rod that has an end that defines a contacting end to contact the ratchet pawl, a contour that defines the protrusion and a bend that defines an actuation end connected to a locking button through an opening in the handle.

3. A ratchet wrench according to claim 2 wherein it also comprises an elastic return element that biases said releasing member to said rest position, and in that said kinematic chain is a unidirectional actuation kinematic chain that transmits the movement of the releasing member when it is moved from the rest position to the release position to the ratchet pawl and it does not transmit movements experienced by the ratchet pawl as it jumps from one tooth to another of the circumferential teeth of the ratchet wheel to the releasing member when the releasing member is held in the rest position by said elastic return element.

4. A ratchet wrench according to claim 3, wherein the ratchet pawl is installed on the handle so that it can pivot around a pivoting axis parallel to said hinge axis and wherein the ratchet pawl is installed on the handle between the ratchet wheel and the releasing member.

5. A ratchet wrench according to claim 4, wherein the releasing member is farther away from the hinge axis in the rest position than in the release position, and said unidirectional actuation kinematic chain comprises a pushing rod linked to the releasing member and a pushing member installed on the handle so that said pushing member can pivot around a pivoting axis, wherein a pushing contact exists between said pushing member and the ratchet pawl only when the pushing member is pivoted by said pushing rod as a result of the movement of the releasing member from the rest position to the release position.

6. A ratchet wrench according to claim 4, wherein the releasing member is closer to the hinge axis in the rest position than in the release position, and said unidirectional actuation kinematic chain comprises a connecting rod that has an end linked to the releasing member by a pivoting juncture and another end linked to ratchet pawl by a pivoting and sliding juncture.

7. A ratchet wrench according to claim 2 wherein the handle comprises a handle body that has a flattened region in which said cavity is formed in which the locking element is housed, and one or more housings in which the ratchet wheel, the ratchet pawl, the releasing member, and other associated elements thereto are housed, and at least one lid fixed to said handle body closing said cavity and said housings.

8. A ratchet wrench according to claim 7, wherein the ratchet wheel has cylindrical hub portions that protrude from both its sides and that are inserted and rotatably guided in respective guide holes formed on said handle body and on said lid, respectively.

9. A ratchet wrench according to claim 8, wherein said functional head further comprises a head body that has two opposed lugs between which an end of said flattened region of the handle is housed where the ratchet wheel is installed and wherein the ratchet wheel has a grooved axial hole, and said lugs of said head body have respective grooved holes aligned with said grooved axial hole of the ratchet wheel, and a grooved ratchet shaft coaxial with the hinge axis is inserted through said grooved holes of the lugs and through the grooved axial hole of the ratchet wheel preventing the relative rotation between the ratchet wheel and the head body.

10. A ratchet wrench according to claim 9, wherein said functional head comprises a head body, two movable clamp bodies installed on said head body so that they can move along a clamp guide arranged in a direction perpendicular to the hinge axis, and a driving mechanism installed on the head body and manually operable to move said clamp bodies, thereby adjusting the spacing between mutually opposed clamp surfaces of the clamp bodies.

11. A ratchet wrench according to claim 10, wherein said driving mechanism comprises a driving screw parallel to said clamp guide rotatably mounted on the head body and located between the clamp guide and the hinge axis, said driving screw having two externally threaded portions with opposite threading directions respectively engaged to corresponding internally threaded sections with opposite threading directions formed on the clamp bodies, respectively and wherein at least on an end of said driving screw a gripping element is fixed in a position accessible to be gripped and turned.

12. A ratchet wrench according to claim 11, wherein said internally threaded sections of the clamp bodies encompass an angle equal to or less than 180° around the driving screw.

13. A ratchet wrench according to claim 12, wherein the head body comprises two side walls with mutually opposed surfaces that define at least part of a screw housing sized to house and rotatably guide the driving screw, and said mutually opposed surfaces of said side walls include respective channels that jointly define the clamp guide.

14. A ratchet wrench according to claim 13, wherein each of the clamp bodies has a respective main guide follower portion that engages one of said channels that jointly define the clamp guide of the head body and a respective auxiliary guide follower portion that slidingly engages a corresponding auxiliary guide slot formed on the other of the clamp bodies.

15. A ratchet wrench according to claim 14, wherein the clamp bodies have respective mutually sliding surfaces perpendicular to the hinge axis and one of the clamp bodies has a rib that protrudes from its corresponding sliding surface and that is slidingly inserted in a slot formed on the sliding surface of the other clamp body.

16. A ratchet wrench according to claim 13, wherein the side walls of the head body comprise respective distal edges parallel to the clamp guide in which longitudinal recesses are formed that slidingly engage guide protrusions formed on the clamp bodies.

17. A ratchet wrench according to claim 10, wherein said driving mechanism comprises a threaded stem rigidly attached to one of the clamp bodies, parallel to said clamp guide and with a first threading direction, an internally threaded section rigidly attached to the other of the clamp bodies, parallel to the clamp guide and with a second threading direction opposite to said first threading direction, and a driving sleeve rotatably mounted but not axially displaceable on the head body, said driving sleeve having a hole with an internal thread with said first threading direction engaged to said threaded stem and an external thread with said second threading direction engaged to said internally threaded section.

18. A ratchet wrench according to claim 17, wherein said internally threaded section of the other clamp bodies encompasses an angle equal to or less than 180° around the driving sleeve.

19. A ratchet wrench according to claim 17, wherein the head body comprises two side walls with mutually opposing surfaces that, along with the head body, define a stem housing sized to house and axially guide the threaded stem, said mutually opposing surfaces of said side walls including respective longitudinal guide elements that jointly define the clamp guide, and the head body further comprises a sleeve housing in the shape of a through-passage in a direction perpendicular to the clamp guide and that intersects said stem housing and the clamp guide.

20. A ratchet wrench according to claim 19, wherein the clamp bodies have respective main guide follower portions that engage said longitudinal guide elements that jointly define the clamp guide of the head body and respective auxiliary guide portions that slidingly engage each other.

* * * * *